US006041943A

United States Patent [19]

Gifford

[11] Patent Number: 6,041,943

[45] Date of Patent: Mar. 28, 2000

[54] ADJUSTABLE GRATING PAIN ROCK SIFTER

[75] Inventor: Philip Arthur Gifford, Cherhill, Canada

[73] Assignee: Samuel Lenko, Sangudo, Canada

[21] Appl. No.: 09/130,703

[22] Filed: Aug. 5, 1998

[51] Int. Cl.[7] ..... B07B 1/49

[52] U.S. Cl. ..... 209/394; 209/392; 209/421

[58] Field of Search ..... 209/394, 396, 209/353, 357

[56] References Cited

U.S. PATENT DOCUMENTS

| | | | |
|---|---|---|---|
| 2,484,318 | 10/1949 | Smith | 209/394 |
| 2,734,686 | 2/1956 | Oberhellmann | 209/394 |
| 3,280,977 | 10/1966 | Looker | 209/394 |
| 3,477,573 | 11/1969 | Andersson | 209/394 |
| 3,805,952 | 4/1974 | Pleus | 209/394 |

FOREIGN PATENT DOCUMENTS

| | | | |
|---|---|---|---|
| PCT/SE90/00265 | 4/1990 | European Pat. Off. | E02F 7/00 |
| 002658097 | 8/1991 | France | 209/396 |
| 1042-818 | 9/1983 | U.S.S.R. | 209/394 |

*Primary Examiner*—Donald P Walsh
*Assistant Examiner*—Daniel Schlak
*Attorney, Agent, or Firm*—Christensen O'Connor Johnson & Kindness PLLC

[57] ABSTRACT

A sorting apparatus includes a first grating of spaced parallel bars and a second grating of spaced parallel bars positioned parallel to the first grating. Relative lateral movement of the first grating and the second grating alters the lateral spacing between the parallel bars of the first grating in relation to the parallel bars of the second grating. This enables rocks to be sorted into three piles; a first pile of rocks that will pass through when openings in the first grating and second grating are out of register, a second pile of rocks that will pass through only when openings in the first grating and second grating are in register, and a third pile of rocks that will not pass through.

6 Claims, 2 Drawing Sheets

ADJUSTABLE GRATING PAIN ROCK SIFTER

FIELD OF THE INVENTION

The present invention relates to a sorting apparatus and, in particular, a sorting apparatus capable of sorting differing sizes of rock.

BACKGROUND OF THE INVENTION

When sorting rocks into different sizes, either the rock must be taken to a stationary sorting apparatus referred to as a "grizzly" or a movable sorting apparatus referred to as a "separator bucket" must be taken to the rock. Both a grizzly and a separator bucket operate in a similar fashion. A grid is provided that allows rocks that are smaller than the openings in the grid to fall through and prevents rocks larger than the grid from passing through. By passing the rocks through a series of grids, the rocks can be sorted with greater and greater precision until a quantity of rocks of a desired size are obtained. International Application PCT/SE90/00265 published under the Patent Cooperation Treaty as International Publication Number WO90/12929, illustrates a form of sorting apparatus which is more elaborate than most. In the sorting apparatus disclosed in this PCT publication the grid consists of a number of parallel rods. One end of each rod is attached to a front plate, the opposed end of each rod is attached to a rear plate. The front plate and the rear plate are movable vertically relative to each other to facilitate the movement of material through the grid. With most sorting apparatus of this type the grid is stationary and gravity is relied upon to urge the material through the grid. It takes considerable time to sort rock through a series of grids of differing size. Mechanism to accelerate the sorting process, such as disclosed in the PCT application, is generally viewed as beneficial as it decreases the cost of producing the required quantity of rock of a specific size.

SUMMARY OF THE INVENTION

What is required is a sorting apparatus that can accelerate the sorting process.

According to the present invention there is provided a sorting apparatus which includes a first grating of spaced parallel bars and a second grating of spaced parallel bars positioned parallel to the first grating. Means is provided for causing relative lateral movement of the first grating and the second grating. This alters the lateral spacing between the parallel bars of the first grating in relation to the parallel bars of the second grating.

With the sorting apparatus, as described above, rocks must pass through not just one grating but two gratings: a first grating and a second grating. At least one of the first grating and the second grating is laterally movable relative to the other. It is preferred that the spacing between the parallel bars of the gratings be substantially the same. When the gratings are positioned with the openings between the parallel bars in register, the rock size that will pass through the grid is determined by the spacing of the parallel bars. When the grating are positioned with the openings between the parallel bars out of register, the parallel bars of the second grating serves to cut the size of the openings available for rocks to pass by half, thereby reducing the size of rocks that can pass through. This enables three ranges of sizes of rocks to be handled in one load. First the first grating and the second grating are placed out of register, so that only small rocks can pass through the openings in the first grating onto a first pile, the spacing available for the passage of rocks having been narrowed by the positioning of the parallel bars of the second grating. Then the first grating and the second grating are placed in register, so that rocks approximately up to twice as large as those in the first pile can pass through the parallel bars onto a second pile. Finally, any rocks too large to pass through the parallel bars when they are in register are dumped into a third pile for further sorting. This allows three piles to be created in substantially the same time as it takes other sorting apparatus to produce two piles.

The apparatus can be modified so that the first grating and the second grating also can be placed in one or more predetermined positions relative to each other so that the spacing between the parallel bars is intermediate between that of the fully in register and fully out of register positions. By this means the apparatus can be used to sort rocks by size into three piles.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
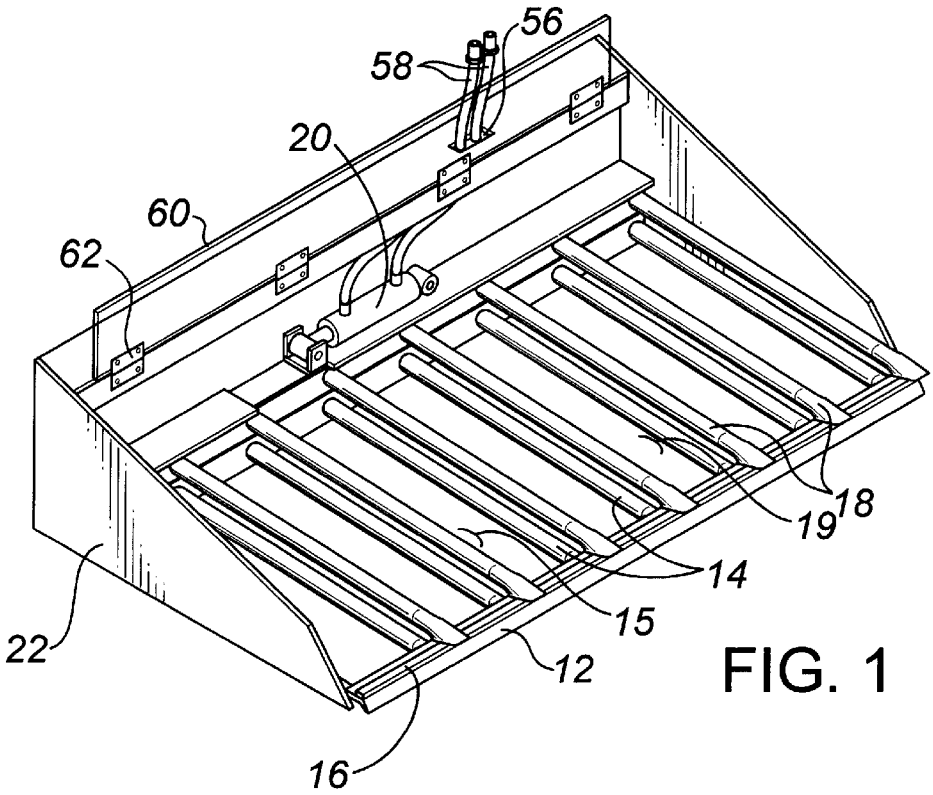
FIG. 1 is a perspective view of a sorting apparatus constructed in accordance with the teachings of the present invention, with openings between parallel bars in a first grating and a second grating shown in register.

The preferred embodiment, a sorting apparatus generally identified by reference numeral 10, will now be described with reference to FIGS. 1 through 3.

With reference to FIG. 1, sorting apparatus 10 comprises a first grating 12 of spaced first parallel bars 14 and a second grating 16 of spaced second parallel bars 18 positioned parallel to the first grating 12. The second grating 16 is substantially the same as the first grating 12 but with one less second parallel bar 18 than first parallel bars 14. Referring to FIG. 3, spaces 19 between the second parallel bars 18 are of substantially the same size as spaces 15 between parallel bars 14. The first parallel bars 14 and the second parallel bars 18 may be either solid rods or tubular bars.

Figure 2:
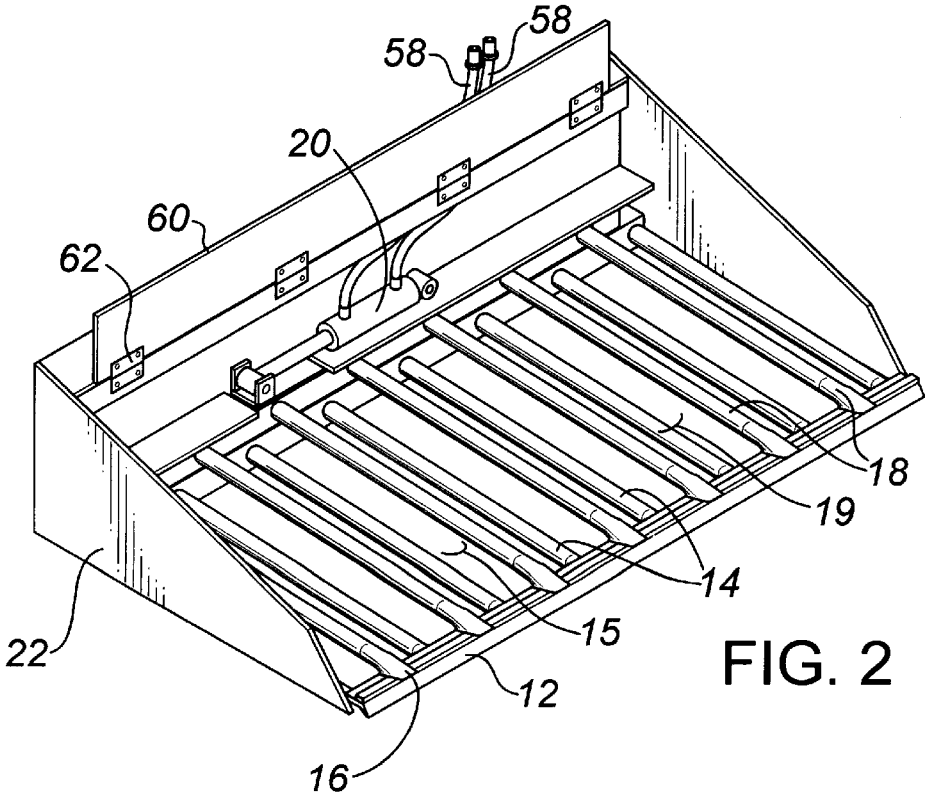
FIG. 2 is a perspective view of the sorting apparatus illustrated in FIG. 1, with the openings between the parallel bars in the first grating and the second grating shown out of register.

Referring to FIGS. 1 and 2, the second grating 16 is attached to a telescopically extendible actuator cylinder 20 for causing relative lateral movement of the first grating 12 and the second grating 16, thereby altering the lateral spacing between the first parallel bars 14 in relation to the second parallel bars 18. In the illustrated embodiment of the sorting apparatus 10, the first grating 12 and the second grating 16 have two predetermined relative positions. In the first position, the spaces 15 between the first parallel bars 14 and the spaces 19 between the second parallel bars 18 are substantially in register as illustrated in FIG. 1. In the second position, the spaces 15 between the first parallel bars 14 and the spaces 19 between the second parallel bars 18 are substantially out of register as illustrated in FIG. 2, thereby narrowing the space available for rocks to pass through.

With reference to FIGS. 1 and 2, the first grating 12 is placed rigidly within a housing 22. Second grating 16 can move laterally within housing 22. Housing 22 is substantially open at the top and the bottom to allow rocks to pass through.

Figure 3:
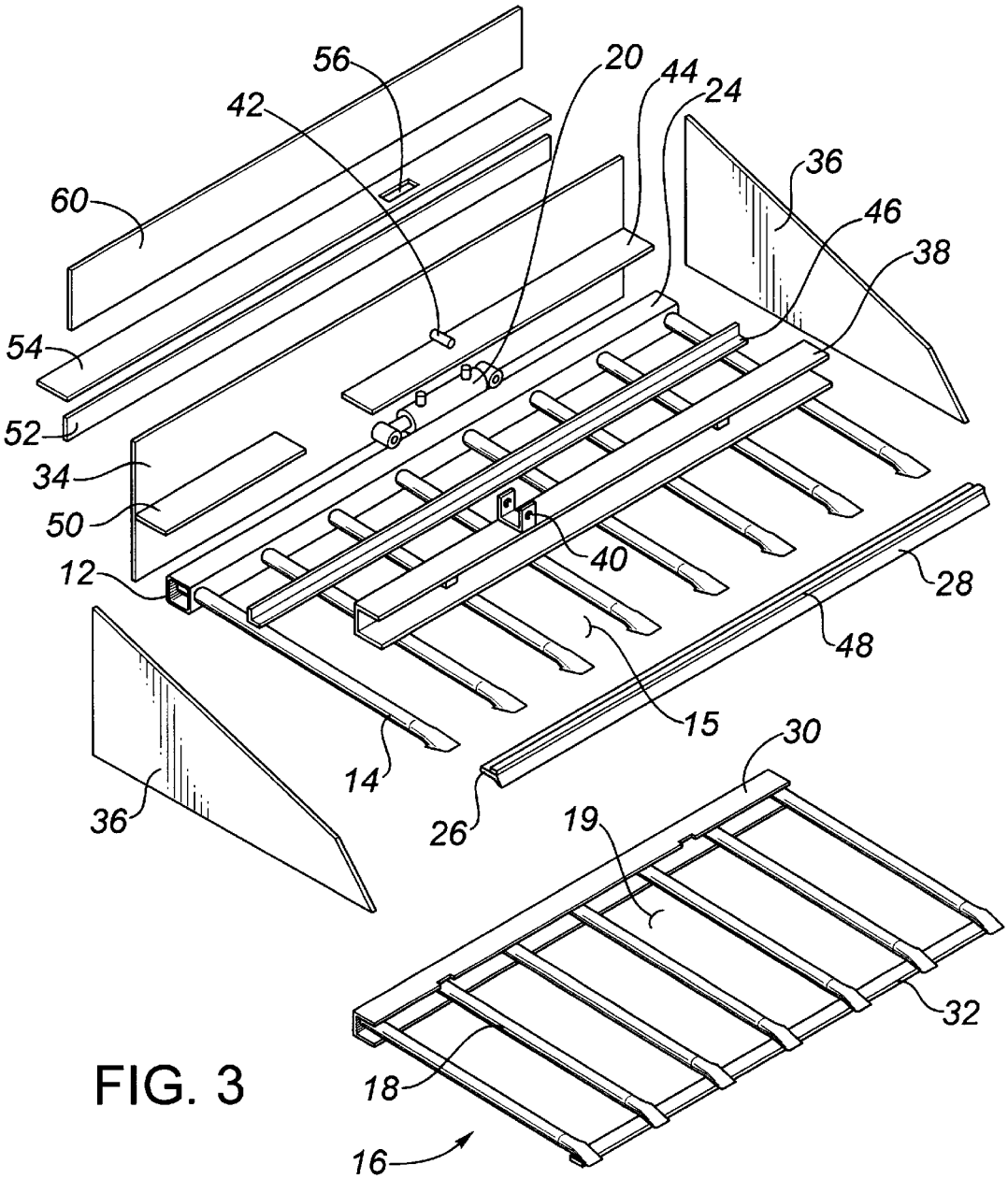
FIG. 3 is an exploded perspective view of the sorting apparatus illustrated in FIG. 1.

With reference to the exploded view illustrated in FIG. 3, first parallel bars 14 of first grating 12 are spaced in a regular manner along the rear principal support member 24 and the front support member 26. A blade 28 is attached to front support member 26. Similarly, second parallel bars 18 of second grating 16 are spaced in substantially the same manner along rear support member 30 and front support member 32.

Housing 22 includes a backboard 34 and side panels 36. First grating 12 is attached rigidly to housing 22. Rear support member 30 of second grating 16 is inserted into and attached to channel beam 38. Telescopically extendible actuator cylinder 20 is attached to channel beam 38 by bracket 40 and is attached to backboard 34 by rod 42. Actuator cylinder 20 is supported on panel 44 attached to backboard 34. Channel beam 38 can move laterally relative to backboard 34 along support 46 and the top face 48 of support member 26 of first grating 12 and beneath panel 44 and panel 50.

With backboard 34, rigidly attached cover panels 52 and 54 and hinged cover panel 60 comprise a covered housing for actuator cylinder 20. A hole 56 in panel 54 allows connection by hydraulic conduit from an external hydraulic unit to actuator cylinder 20, as illustrated in FIGS. 1 and 2. Cover panel 60 is attached to cover panel 52 by means of hinges 62 and completes the enclosure of actuator cylinder 20 when in the closed position.

The use and operation of apparatus 10 will now be described with reference to FIGS. 1 through 3. Referring to FIGS. 1 and 2, with the sorting apparatus 10, as described above, rocks must pass through not just one grating but two gratings: a first grating 12 and a second grating 16. A first step in sorting rocks is to place the first grating 12 and the second grating 16 out of register, as illustrated in FIG. 2, by extending telescopic actuator cylinder 20. In this position only small rocks can pass through both gratings 12 and 16 to form a first pile. The spacing 15 available for the passage of rocks through first grating 12 having been narrowed by the positioning of the second parallel bars 18 of the second grating 16 in the way. The smaller rocks pass through gratings 12 and 16 of apparatus 10 onto the first pile, while larger rocks remain supported upon grating 12. A second step in sorting rocks involves moving to a second pile and actuating cylinder 20 to move the second grating 16 into register with the first grating 12 as illustrated in FIG. 1. In this position, rocks approximately up to twice as large as those in the first pile can pass through the first parallel bars 14 onto the second pile. Finally, any rocks too large to pass through the spaces 15 in the first parallel bars 14 and spaces 19 in the second parallel bars 18 when they are in register are dumped into a third pile for further sorting. This allows three piles to be created in substantially the same time as it takes other sorting apparatus to produce two piles.

It will be apparent to one skilled in the art that the apparatus can be modified so that the first grating 12 and the second grating 16 can be placed in two predetermined positions relative to each other to allow the spacing between the first parallel bars 14 and the second parallel bars 18 to be intermediate between that of the fully in register and fully out of register positions. By this means the apparatus can be used to sort rocks by size into three piles. It will also be apparent to one skilled in the art that modifications may be made to the illustrated embodiment without departing from the spirit and scope of the invention as hereinafter defined in the Claims.

The Embodiments of the invention in which an exclusive property or priviledge is claimed are defined as follows:

1. An adjustable grating pair rock sifter, comprising:

a housing having a backboard, side panels, an open top, an open bottom, and an open front;

a first grating of spaced parallel bars positioned across the housing between the side panels, such that in order for any objects to pass through the housing from the top to the bottom such objects must pass through the first gating;

a second grating of spaced parallel bars positioned parallel to the first grating; and means for causing relative lateral movement of the first grating and the second grating, thereby altering the lateral spacing between the parallel bars of the first grating in relation to the parallel bars of the second grating.

2. The adjustable grating pair rock sifter as defined in claim 1, wherein the first grating and the second grating are substantially the same size and have close to the same number of parallel bars having spaces between the parallel bars of substantially the same size.

3. The adjustable grating pair rock sifter as defined in claim 2, wherein the first grating and the second grating have two positions, a first position in which the spaces between the parallel bars in the first grating and the second grating are substantially in register and a second position in which the spaces between the parallel bars in the first grating and the second grating are substantially out of register.

4. The adjustable gratings pair rock sifter as defined in claim 1, wherein the means for causing relative lateral movement of the first grating and the second grating is a telescopically extendible actuator cylinder.

5. The adjustable grating pair rock sifter as defined in claim 1, wherein the housing has a forwardly projecting blade and is adapted for attachment to a vehicle.

6. An adjustable grating pair rock sifter, comprising:

a housing adapted for attachment to a vehicle and having a backboard, side panels, an open top, an open bottom, an open front, and a forwardly projecting blade;

a first grating of spaced parallel bars positioned across the housing between the side panels, such that in order for any objects to pass through the housing from the top to the bottom such objects must pass through the first grating;

a second grating of spaced parallel bars positioned parallel to the first grating, the second grating being substantially the same as the first grating with the same number of parallel bars and spaces between the parallel bars of substantially the same size; and a telescopically extendible actuator cylinder for causing relative lateral movement of the first grating and the second grating, thereby altering the lateral spacing between the parallel bars of the first grating in relation to the parallel bars of the second grating, the first grating and the second grating having two positions, a first position in which the spaces between the parallel bars in the first grating and the second grating are substantially in register and a second position in which the spaces between the parallel bars in the first grating and the second grating are substantially out of register, thereby narrowing the space available for rocks to pass through.

* * * * *

UNITED STATES PATENT AND TRADEMARK OFFICE

CERTIFICATE OF CORRECTION

PATENT NO. : 6,041,943
DATED : March 28, 2000
INVENTOR(S) : P.A. Gifford

It is certified that error appears in the above-identified patent and that said Letters Patent is hereby corrected as shown below:

| COLUMN | LINE | ERROR |
|---|---|---|
| [54] Pg.1, col.1 | Title | "PAIN" should read--PAIR-- |
| 1 | 1 | "PAIN" should read--PAIR-- |

Signed and Sealed this

Fifth Day of June, 2001

*Attest:*

*Attesting Officer*

Nicholas P. Godici

NICHOLAS P. GODICI

*Acting Director of the United States Patent and Trademark Office*